US007861877B2

(12) United States Patent
Higgins

(10) Patent No.: US 7,861,877 B2
(45) Date of Patent: Jan. 4, 2011

(54) FOLDABLE CONTAINER

(75) Inventor: Scott Higgins, Ozark, MO (US)

(73) Assignee: Custom Metalcraft, Inc., Springfiled, MO (US)

( * ) Notice: Subject to any disclaimer, the term of this patent is extended or adjusted under 35 U.S.C. 154(b) by 723 days.

(21) Appl. No.: 11/694,477

(22) Filed: Mar. 30, 2007

(65) Prior Publication Data

US 2007/0227938 A1 Oct. 4, 2007

Related U.S. Application Data

(63) Continuation-in-part of application No. 11/693,472, filed on Mar. 29, 2007, now abandoned.

(60) Provisional application No. 60/744,062, filed on Mar. 31, 2006.

(51) Int. Cl.
*B65D 6/00* (2006.01)
*B65D 8/14* (2006.01)
*B65D 21/00* (2006.01)

(52) U.S. Cl. ..... 220/6; 206/511

(58) Field of Classification Search ..... 220/1.6, 220/4.28, 6, 578; 206/511, 600
See application file for complete search history.

(56) References Cited

U.S. PATENT DOCUMENTS 1,164,289 A * 12/1915 Cocchiarella ..... 251/109
1,335,643 A 3/1920 Beers et al.
2,696,929 A 12/1954 Morterol
2,952,379 A 9/1960 Potter
3,130,850 A 4/1964 Oakey et al.
3,635,368 A 1/1972 Winsor
3,968,895 A 7/1976 Barnes, Jr. et al.
4,366,905 A * 1/1983 Forshee ..... 206/511
4,673,087 A 6/1987 Webb
4,735,331 A 4/1988 Keenan et al.
4,817,824 A 4/1989 LaFleur et al.
5,056,667 A 10/1991 Coogan
5,161,709 A 11/1992 Oestreich, Jr.
5,253,763 A 10/1993 Kirkley et al.
5,269,414 A 12/1993 D'Hollander
5,361,923 A 11/1994 Knight, IV et al.
5,467,885 A * 11/1995 Blinstrub ..... 220/6
5,507,392 A 4/1996 Schutz
5,564,599 A 10/1996 Barber et al.
5,611,449 A * 3/1997 Pedersen ..... 220/6
D414,333 S 9/1999 Barber et al.
6,006,918 A 12/1999 Hart
D431,358 S 10/2000 Willemsen
6,135,287 A 10/2000 Hartwall (Continued)

FOREIGN PATENT DOCUMENTS

GB 2037709 A * 7/1980

*Primary Examiner*—Harry A Grosso
(74) *Attorney, Agent, or Firm*—Hovey Williams LLP

(57) ABSTRACT

A foldable container comprises a box including a floor and sidewalls attached to one another to present a chamber. The box further includes foldable panels that shift from a retracted position within the chamber to an upright extended position. The extended panels serve to expand the chamber for containing a liquid or solid bulk material. The extended panels are interconnected by joints that resist tampering and that are tamper-evident. The container further includes a retaining assembly for securely holding the material in the chamber and a lid for covering the chamber. The lid cooperates with the panels to resist tampering and to be tamper-evident. The container also includes stanchions for selectively stacking at least two containers when the containers are storing the bulk material.

66 Claims, 14 Drawing Sheets

U.S. PATENT DOCUMENTS

| | | | | |
|---|---|---|---|---|
| 6,170,689 | B1 | 1/2001 | Flesher et al. | |
| 6,401,953 | B2 | 6/2002 | Kofod | |
| 6,415,938 | B1 | 7/2002 | Karpisek | |
| 6,533,122 | B1 | 3/2003 | Plunkett | |
| 6,902,061 | B1 | 6/2005 | Elstone | |
| 6,955,273 | B2 | 10/2005 | Hartwall | |
| 7,066,332 | B2 | 6/2006 | Kobayashi et al. | |
| 7,093,731 | B2 | 8/2006 | Karpisek | |
| 7,222,471 | B2 * | 5/2007 | Matsumoto et al. | 53/449 |
| 2003/0150769 | A1 | 8/2003 | Lau | |
| 2004/0232146 | A1 | 11/2004 | Kessler et al. | |
| 2004/0238400 | A1 | 12/2004 | Knutsson et al. | |

* cited by examiner

FOLDABLE CONTAINER

RELATED APPLICATION

This application is a continuation-in-part of U.S. patent application Ser. No. 11/693,472, filed Mar. 29, 2007, entitled FOLDABLE CONTAINER, which claims the benefit of U.S. Provisional Application No. 60/744,062, filed Mar. 31, 2006, entitled FOLDABLE CONTAINER, both of which are hereby incorporated by reference in their entirety.

BACKGROUND OF THE INVENTION

1. Field of the Invention

The present invention relates generally to material storage containers. More specifically, embodiments of the present invention concern a foldable intermediate bulk container that is stackable with similar containers when in either a folded or unfolded configuration.

2. Discussion of Prior Art

Intermediate bulk containers (IBCs) for transporting various solids and liquids are well known in the art. Conventional IBCs take up a substantial amount of space when in use. But some prior art IBCs include collapsible sides so that the container can be collapsed to a relatively smaller size when not in use. Consequently, these collapsible containers take up less space when collapsed aid are more convenient to store and transport when not in use.

Prior collapsible IBCs are problematic and suffer from various undesirable limitations. For example, prior art IBCs are generally prone to tampering and permit external objects to interfere with or contaminate the load contained therein. These containers present various locations of weakness that permit a foreign object to pass through the container structure and into the internal chamber of the container. Collapsible containers are particularly problematic in this regard because the collapsible elements can naturally produce various weak points between the elements that permit tampering with a container load. Moreover, foldable IBCs generally do not comply with the controlling state and federal regulations governing the storage of certain food and/or medical related products and cannot store these types of products. Additionally, the prior art foldable IBCs are unable to handle larger quantities of products and are not cost-effective to manufacture for such applications. Another problem with prior art IBCs is that such containers do not safely contain liquid materials. In particular, liquids are prone to substantial weight shifts that can result in either instability or tipping of the container. Yet another problem with prior art IBCs is that they are not stackable when storing a load therein. Prior art containers are typically not structurally strong enough to support a fully-loaded container in a stacked configuration while being cost-effective to manufacture. Still another problem is that prior art containers do not accommodate gravity discharge of the stored material directly from the container while the container remains upright. Accordingly, there is a need for an improved collapsible IBC that overcomes these limitations.

SUMMARY

Preferred embodiments of the present invention provide a foldable container that does not suffer from the problems and limitations of the prior art IBCs discussed above.

A first aspect of the illustrated embodiment concerns a collapsible container configured for holding a bulk material load therein and operable to restrict tampering with the load.

The collapsible container broadly includes a box and a lid. The box includes a floor and a sidewall surrounding the floor, with the floor and sidewall being interconnected to form a load-receiving chamber that is operable to receive the bulk material load. The sidewall presents an upper edge spaced upwardly from the floor. The box includes a plurality of panels attached to a remainder of the box and projecting uprightly above the sidewall in an extended position to expand the chamber, with the panels presenting uppermost edge sections that form an open container top. The lid includes a rim that receives the uppermost edge sections, with the lid overlying the open container top to enclose the chamber. The plurality of panels include a pair of adjacent panels with interconnected joint elements. The joint elements extend substantially from the upper edge to the rim and define a seam therebetween. One of the joint elements presents an external surface that covers the other joint element from the upper edge to the rim to restrict access through the seam and into the chamber.

A second aspect of the illustrated embodiment concerns a stackable container operable to support a substantially similar container stacked thereon. The stackable container broadly includes a box, a lid, and a stanchion. The box includes a floor and a sidewall surrounding the floor, with the floor and sidewall being interconnected to form a load-receiving chamber. The sidewall presents an upper edge spaced upwardly from the floor. The box includes a plurality of panels attached to a remainder of the box and projecting uprightly above the sidewall in an extended position to expand the chamber, with the panels presenting uppermost edge sections that form an open container top. The lid overlies the open container top to enclose the chamber. The stanchion is rigidly attached to the box and projects above the lid to receive the similar container. The stanchion is operable to support at least part of the similar container, with the panels being configured to support any remaining part of the similar container.

A third aspect of the illustrated embodiment concerns a bulk storage container configured for holding a bulk material load therein and for discharging the bulk material load through a conduit. The bulk storage container broadly includes a box including a floor and a sidewall surrounding the floor, with the floor and sidewall being interconnected to form a load-receiving chamber that is operable to receive the bulk material load. The sidewall presents an upper edge spaced upwardly from the floor. The box includes a shelf that is spaced below the floor and is interconnected with the sidewall to form an auxiliary compartment. The floor presents a discharge opening, with the chamber and compartment fluidly communicating with one another through the discharge opening. The sidewall presents an access opening that communicates with the compartment so that the conduit is operable to extend between the openings to discharge the bulk material load through the auxiliary compartment.

A fourth aspect of the illustrated embodiment concerns a bulk storage container configured for holding a bulk material load therein. The bulk storage container broadly includes a box and a substantially rigid wall. The box includes a floor and a sidewall surrounding the floor, with the floor and sidewall being interconnected to form a load-receiving chamber that is operable to receive the bulk material load. The chamber is operable to be filled in an upright fill direction from the floor. The substantially rigid wall is shiftably attached to the box. The rigid wall extends transversely to the fill direction, with the rigid wall having a perimeter that extends along the sidewall. The rigid wall is operable to translate in the fill direction between a plurality of load-engaging positions within the chamber.

Other aspects and advantages of the embodiments of the present invention will be apparent from the following detailed description of the preferred embodiments and the accompanying drawing figures.

BRIEF DESCRIPTION OF THE DRAWING FIGURES

Preferred embodiments of the invention are described in detail below with reference to the attached drawing figures, wherein.

Figure 11:
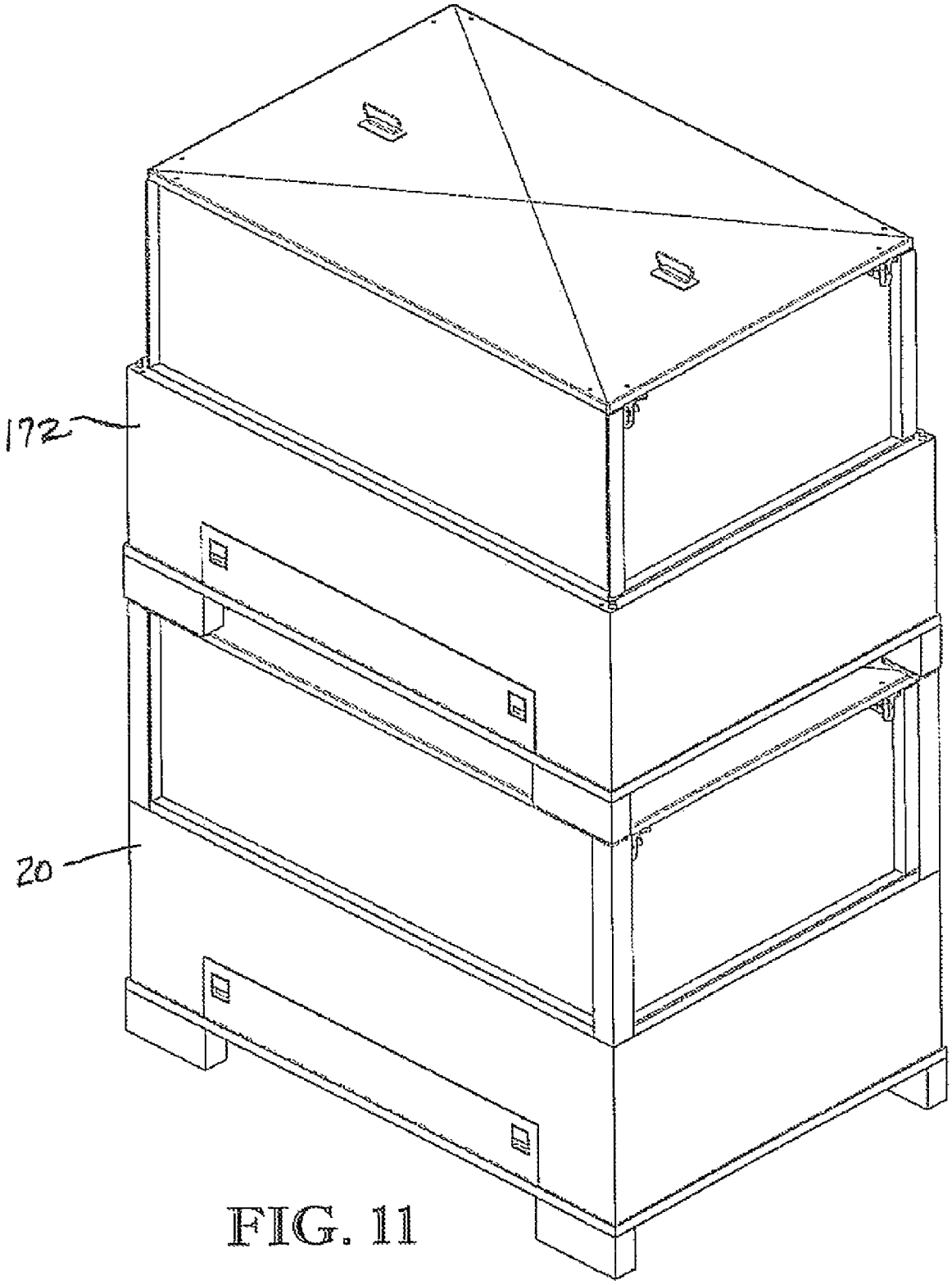
FIG. 11 is a perspective view of the pair of collapsible containers as shown in FIG. 10, with the first container stacked on the second container and supported by the stanchions.
Figure 12:
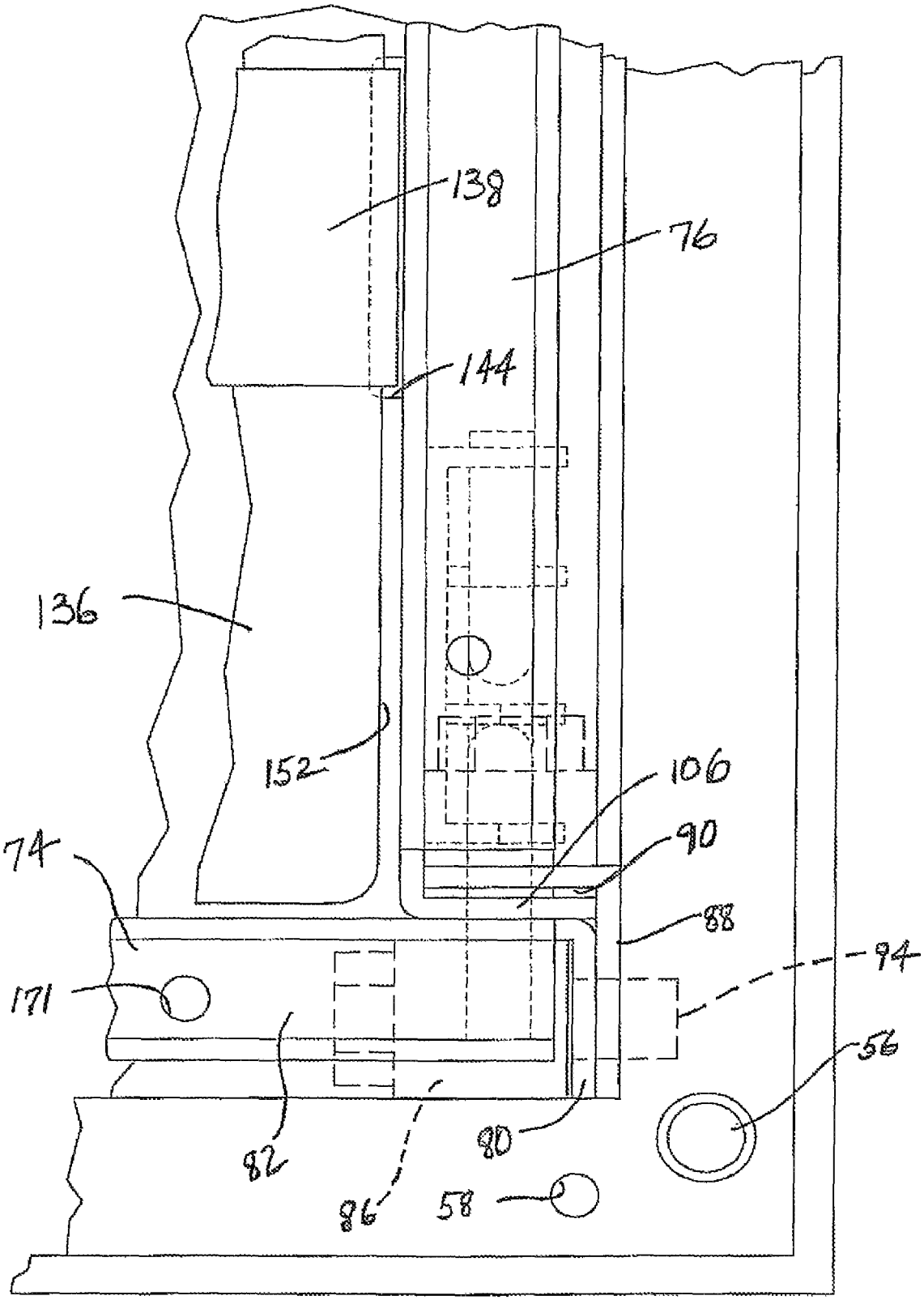
FIG. 12 is a fragmentary top view of the collapsible container shown in FIG. 7, showing a joint formed by the adjacent foldable end and side panels.
Figure 13:
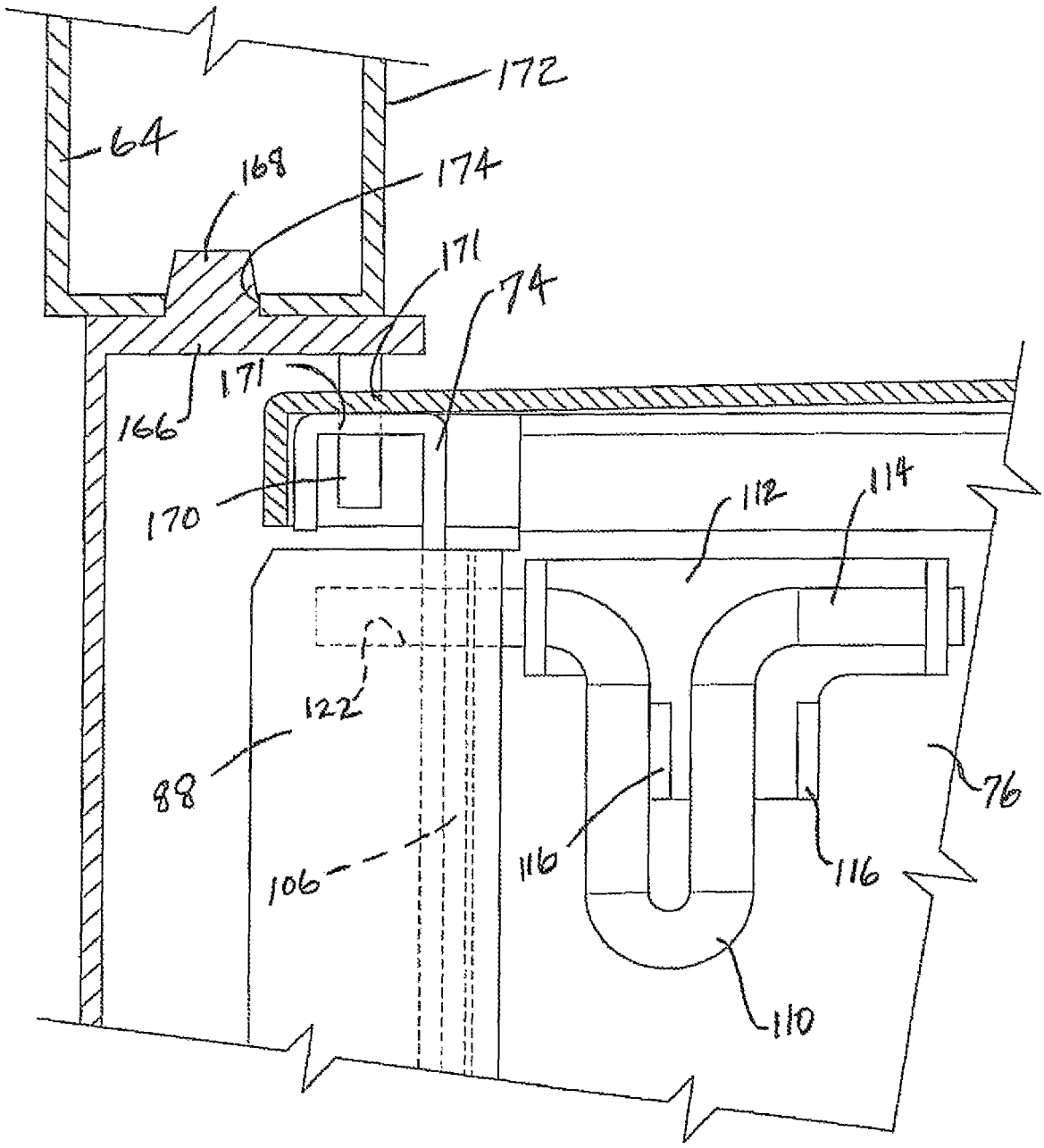
Figure 14:
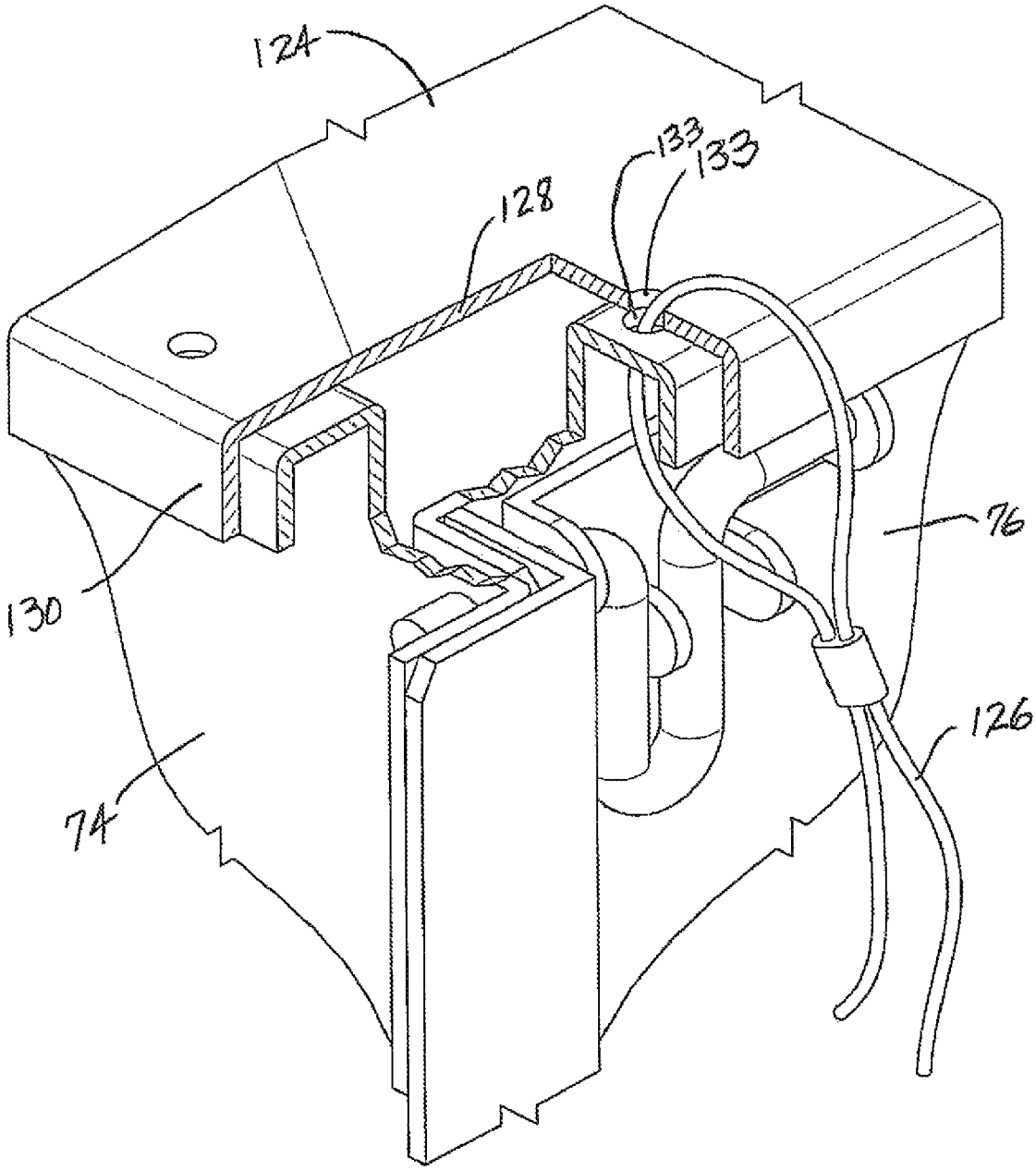

FIG. 13 is a fragmentary cross-sectional view of the pair of collapsible containers as shown in FIG. 11, showing the joint formed by adjacent foldable end and side panels, showing the stanchion engaged with the container lid and side panel of the second container, and showing the stanchion supporting the first container; and FIG. 14 is a fragmentary perspective view in partial cross-section of the collapsible container shown in FIG. 12, showing the lid secured to the end panel by a tamper-evident seal and showing the joint formed by the adjacent foldable end and side panels.

The drawing figures do not limit the present invention to the specific embodiments disclosed and described herein. The drawings are not necessarily to scale, emphasis instead being placed upon clearly illustrating the principles of the preferred embodiment.

DETAILED DESCRIPTION OF THE PREFERRED EMBODIMENTS

Figure 1:
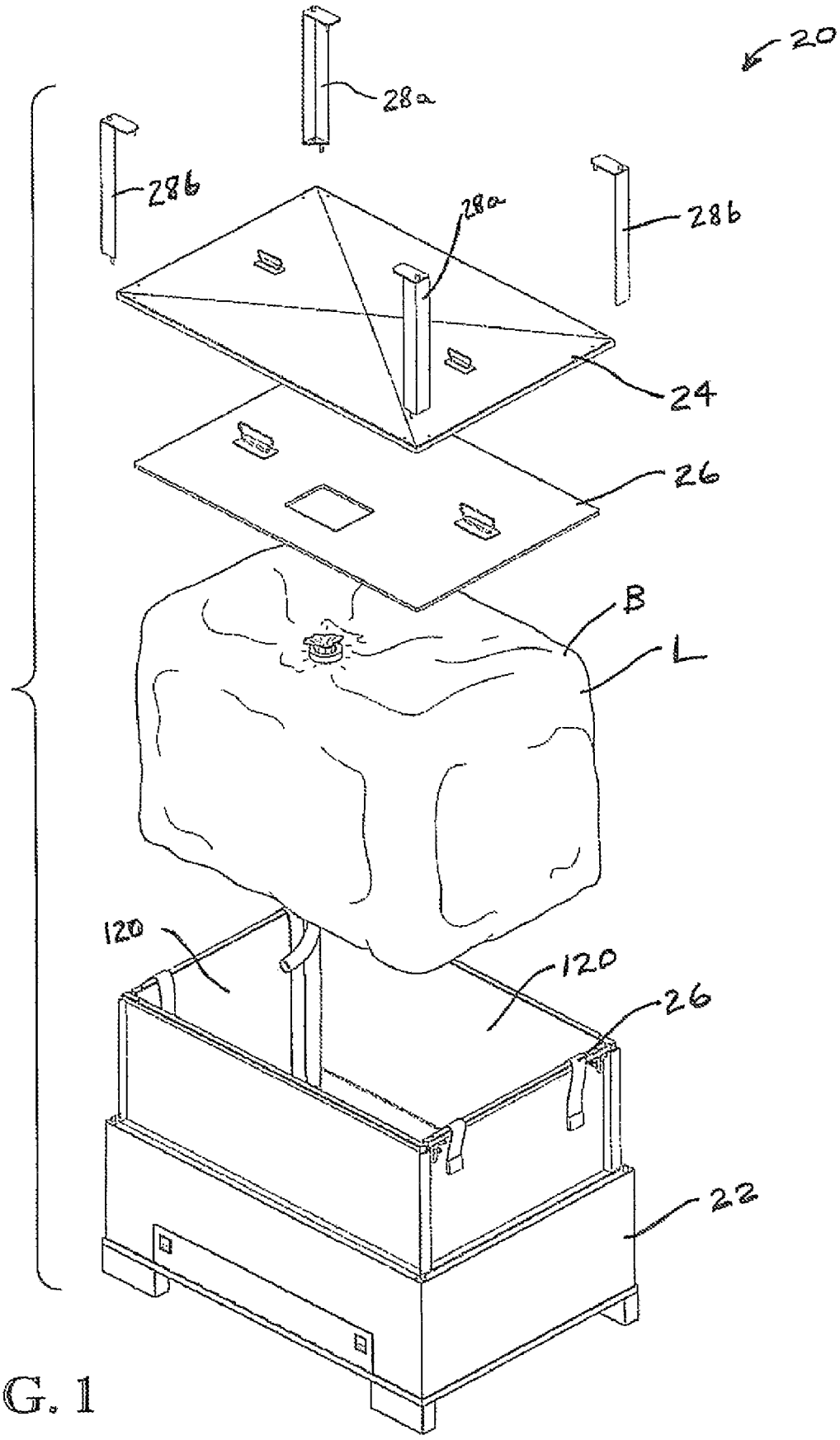
FIG. 1 is a partly exploded view of a collapsible container constructed in accordance with a preferred embodiment of the present invention, showing a container box and also showing a load contained therein, a retainer plate, a lid, and stanchions all exploded from the box.
Figure 8:
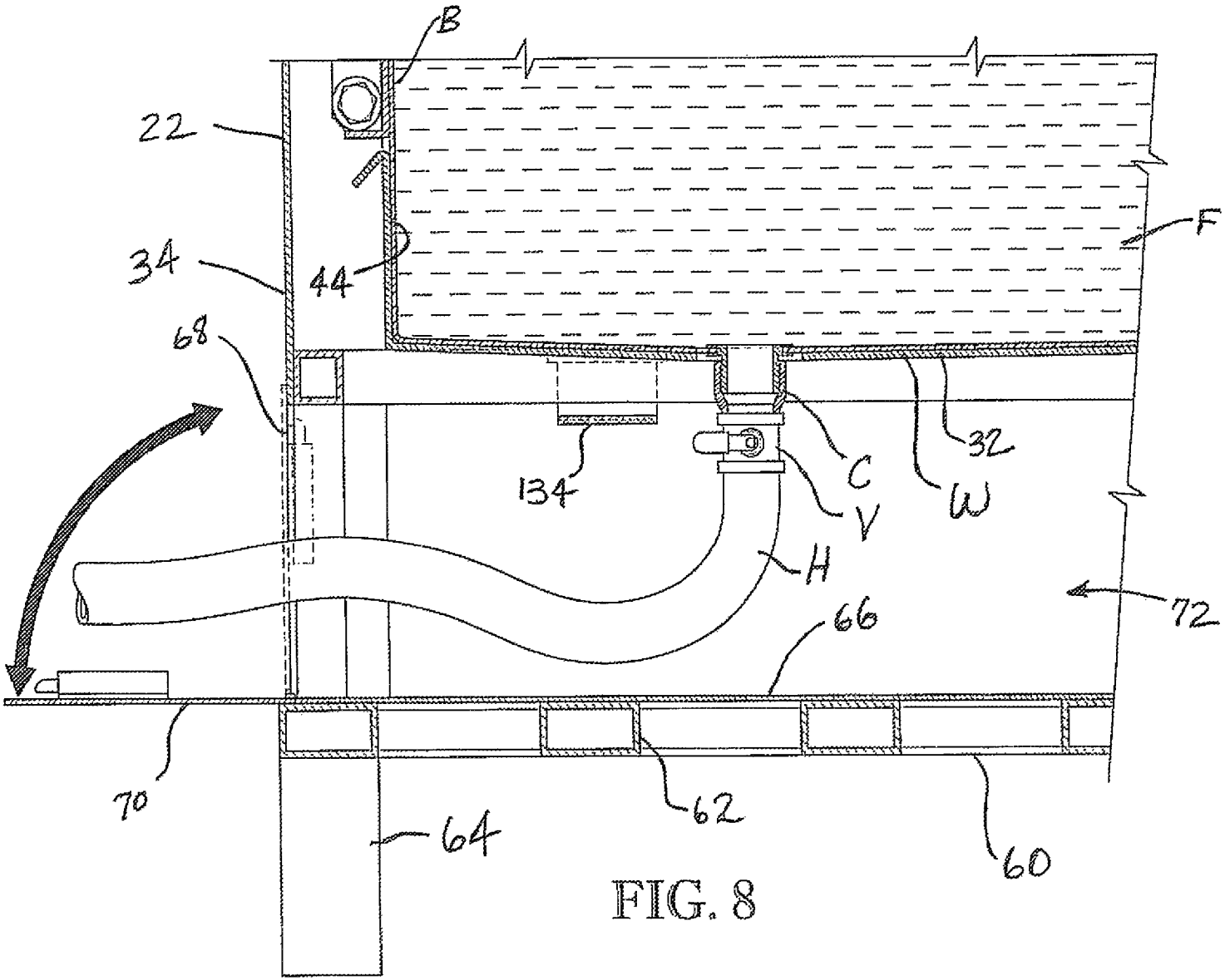
FIG. 8 is a fragmentary cross-sectional view of the collapsible container shown in FIG. 7, showing the access door opened and the discharge hose extending through an auxiliary compartment of the box for discharging material from the load.

Turning initially to FIG. 1, a collapsible container 20 is illustrated and is operable to receive a load L therein. The illustrated load L comprises a bag-type liner B that receives a shipment of bulk material therein. While the illustrated load L preferably includes the bag-type liner B, it is also within the ambit of the present invention where the container 20 receives a load L without the bag-type liner B, or the load L includes another form of liner for holding the bulk material, such as a cardboard liner. The load L further includes a fluid F contained in the liner B, as shown in FIG. 8. The principles of the present invention, however, are applicable where the liner B contains bulk material in various solid forms, such as a granular or powder form. Furthermore, the illustrated container 20 is suitable for holding various materials. While the container 20 is configured to hold various chemicals, such as plastics, it is also configured to comply with regulations for storing food products and medical products. The container 20 is also preferably dimensioned to store up to 2000 liters of material. The collapsible container 20 broadly includes a container box 22, a lid assembly 24, retaining assembly 26, and stanchions 28*a,b*.

Turning to FIGS. 1-6, the container box 22 broadly includes a tubular frame 30, a laterally-extending floor 32, and upright sidewalls 34, with the frame 30, floor 32, and sidewalls 34 being attached to one another and cooperatively forming a chamber 36 that is configured to receive the liner B. The container box 22 is preferably constructed of stainless steel sheet material. In this manner, the container box 22 can be sanitized for use in storing food or medical products. However, it is also consistent with the principles of the present invention where the container box 22 is made of aluminum, carbon steel, or plastic.

The floor 32 is constructed of sheet material and presents a bottom surface 38 and an oval-shaped opening 40, with the bottom surface 38 being sloped downwardly toward the opening 40. While only one opening 40 is shown in the floor 32, it is also within the ambit of the present invention to have more than one opening 40 in the floor 32. The floor 32 preferably is formed with a "Tenors-X" configuration with breaks that cross one another in the usual manner. The floor 32 also presents upright end and side surfaces 42,44 that define a perimeter of the floor 32 and will be discussed further. Preferably, the bottom surface 38 is sloped so as to drop about ⅜" from the surfaces 42,44 to the opening 40. The principles of the present invention, however, are applicable where the floor 32 has an alternative shape, such as being substantially flat, being pitched to a corner thereof, or including arcuately sloped features. The floor 32 is preferably welded to the frame 30 but could be otherwise fixed or removably attached to the frame 30 using various other techniques known to those of ordinary skill in the art, such as by fastening.

The sidewalls 34 preferably present a tubular frame 46 and an outer wall 48 formed of sheet material. The frame 46 includes an upper rim 50 including support sections 52 and support tabs 54. Each support section 52 is located adjacent a corresponding corner formed by the sidewalls 34 and includes an upstanding boss 56 and an aperture 58 (see FIG. 12), the use of which will be subsequently described. It is also consistent with the principles of the present invention where the support section 52 is alternatively configured to include more than one boss 56 or aperture 58, or to not include a boss 56 or aperture 58. The configuration of the support sections 52, as will be shown, is operable to orient and support the stanchions 28*a,b*. The frame 46 is preferably integrally attached to the frame 30, and the outer wall 48 is preferably fixed to the frame 46. Although the illustrated outer wall 48 is flat, it is within the ambit of the present invention for the outer wall 48 to include a pair of breaks similar to the floor 32 or corrugated sections for reinforcement purposes. While the illustrated container box 22 preferably includes four (4) sidewalls 34, it is also consistent with the principles of the present invention for the container box 22 to include less than four sidewalls 34, e.g., a single circular sidewall, or more than four sidewalls 34.

The illustrated frame 30, floor 32, and sidewalls 34 are preferably constructed to form a substantially rigid structure. But the principles of the present invention are equally applicable where the frame 30, floor 32, and sidewalls 34 are shiftably attached to one another or are detachable from one another.

Figure 7:
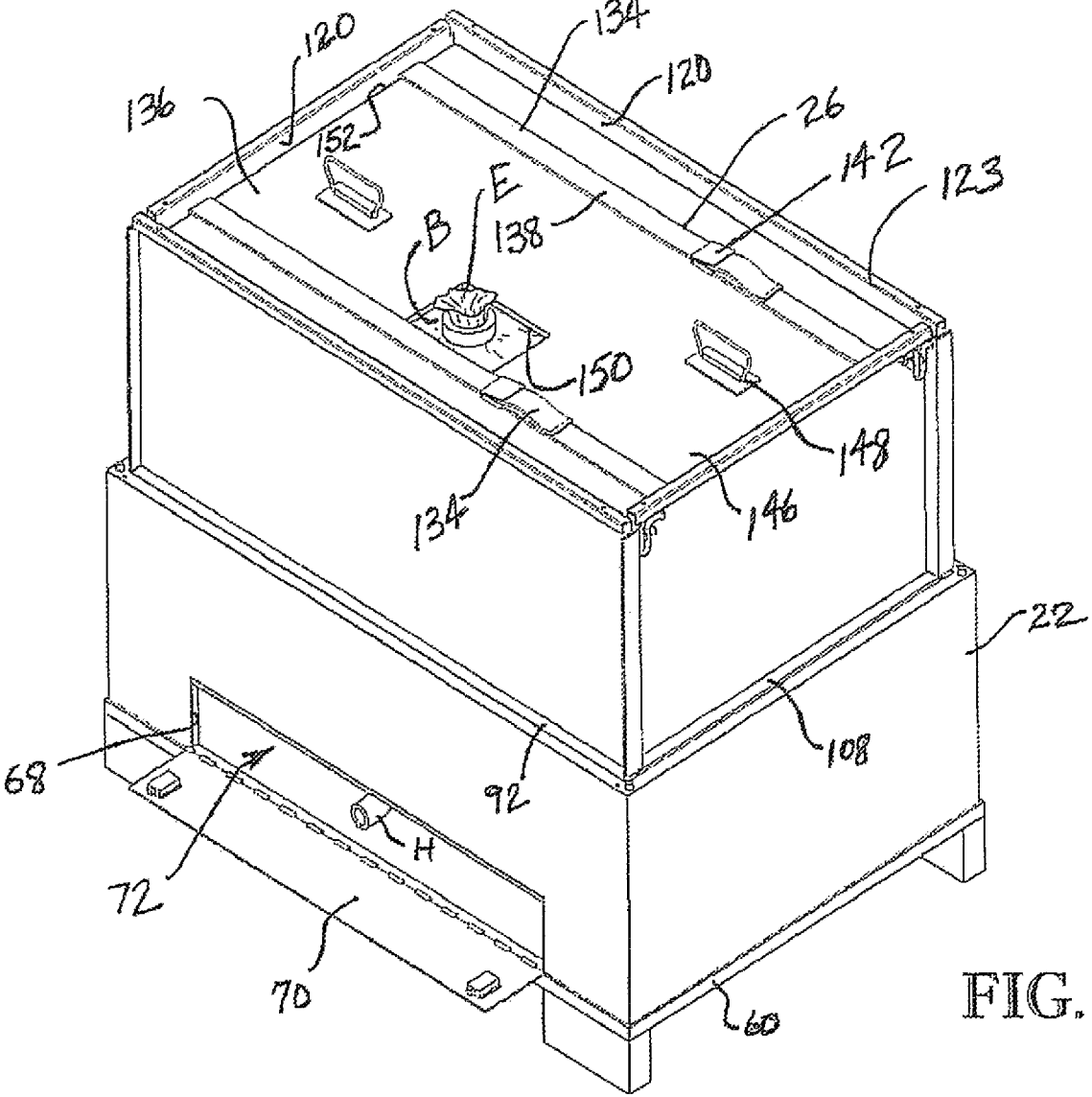
FIG. 7 is a fragmentary perspective view of the collapsible container shown in FIGS. 1-6, showing the foldable end panels pivoted into an extended position, with the load being received in the chamber and secured therein by the retainer plate and the strap assemblies, also with an access door of the box being open to expose a discharge hose of the load.

Turning to FIGS. 7 and 8, the container box 22 further includes a platform 60 fixed to the sidewalls 34 for supporting the container box 22 on a surface. The platform 60 includes a frame 62, feet 64 attached to each corner of the frame 62, and a shelf 66 spaced below the floor 32 and attached to the frame 62. The sidewalls 34 and platform 60 cooperatively present access openings 68 that are oppositely spaced from one another. The container box 22 further includes a pair of oppositely spaced access doors 70 that are pivotally attached to the sidewalls 34 and are operable to cover respective openings 68 (see FIGS. 4 and 5). The floor 32, sidewalls 34, and shelf 66 cooperatively define an auxiliary compartment 72, the use of which will be discussed in greater detail. Spacing of the feet 64 below the shelf 66 forms an open space beneath the platform 60 for lifting the container 20, preferably with a forklift or pallet jack. In particular, the feet 64 are positioned on the platform 60 to present four openings so that lifting arms can extend under the platform 60 from four different directions to lift the container 20.

Turning again to FIGS. 1-6, the container box 22 further includes foldable side panels 74 and foldable end panels 76 that serve to extend the chamber 36. As will be shown in greater detail, the panels 74,76 are configured to shift from a retracted position, where the container 20 is in a collapsed configuration, to an extended position, where the container 20 is in an expanded configuration to receive the load L. The collapsed configuration permits efficient storage of the container 20 because there is substantially less open space within the container 20 when it is collapsed compared to when it is expanded.

Each side panel 74 includes a generally rectangular body 78 that presents side edges 80 and upper and lower edges 82,84. The side panels 74 also preferably include cylindrical hinge elements 86 attached to the body 78 and spaced adjacent the lower edge 84. Each side panel 74 further includes flange elements 88 that are attached to the body 78 and spaced along respective side edges 80. The flange elements 88 have an L-shaped cross section presenting two legs, with one leg being fixed to the side edge 80 and the other leg projecting inwardly along the body 78 to present a groove 90 that extends along the length of the flange element 88 (see FIGS. 12 and 13). The side panels 74 also include a lateral stiffener 92 preferably in the form of an angle brace and welded to the body 78 to extend from one side edge 80 to the other.

The side panels 74 are preferably pivotally attached to the corresponding sidewalls 34 by a bolt-shaped hinge element 94 that extends through the cylindrical hinge element 86 so that the side panels 74 are each attached by a hinged joint and are foldable between retracted and extended positions. The principles of the present invention, however, are equally applicable where the side panels 74 are shiftably attached to the sidewalls 34 by another mechanism, such as a joint that permits relative sliding movement. Furthermore, it is within the ambit of the present invention where the side panels 74 are entirely removable from a remainder of the box 22 so as to be shifted from the extended position to the retracted position.

The end panels 76 include a generally rectangular body 96 that presents side edges 98 and upper and lower edges 100, 102. The end panels 76 also preferably include cylindrical hinge elements 104 attached to the body 96 and spaced adjacent the lower edge 102. Each end panel 76 further includes rib elements 106 formed by the body 96 and defining respective side edges 98 (see FIGS. 12 and 13). The end panels 76 also include a lateral stiffener 108 preferably welded to the body 96 and extending from one side edge 98 to the other. Each end panel 76 preferably has a pair of locking fasteners 110 that are attached to the end panel 76 adjacent the upper edge 100 thereof. The locking fasteners 110 each preferably include a bracket 112 fixed to tie end panel 76 and a bolt 114 slidably retained in the bracket 112 (see FIGS. 12 and 13). The bolt 114 is operable to rotate within and slide along the bracket 112, with prongs 116 of the bracket 112 being configured to hold the bolt 114 in either a locked or unlocked position.

The end panels 76 are preferably pivotally attached to the corresponding sidewalls 34 by a bolt-shaped hinge element 118 so that the end panels 76 are each attached by a hinged joint and are foldable between retracted and extended positions. The principles of the present invention, however, are equally applicable where the end panels 76 are shiftably attached to the box 22 by another mechanism, such as a joint that permits relative sliding movement. Furthermore, it is within the ambit of the present invention where the end panels 76 are entirely removable from a remainder of the box 22 so as to be shifted from the extended position to the retracted position.

The panels 74,76 present inner panel surfaces 120 that are substantially smooth. In other words, the body 78 and body 96 are both preferably substantially flat between corresponding edges thereof to present the smooth inner panel surfaces 120. When the panels 74,76 are extended, each of the panel surfaces 120 are positioned substantially flush with a corresponding one of the surfaces 42,44 to form chamber surfaces that are substantially flat. In this manner, the container 20 is operable to receive the load L without causing damage to the load L due to a sharp or irregular surface or edge.

In the illustrated embodiment, the end panels 76 are pivotally attached to the sidewalls 34 at a first vertical location between the floor 32 and the upper rim 50 of the sidewalls 34. The side panels 74 are pivotally attached to the sidewalls 34 at a second vertical location between the floor 32 and the upper rim 50, with the second vertical location being spaced vertically above the first vertical location. As will be discussed, this spacing permits the panels 74,76 to be folded for storage. The principles of the present invention, however, are applicable where each of the panels 74,76 are pivotally attached at different vertical locations from one another.

The pivotal attachment of the panels 74,76 to the sidewalls 34 below the upper rim 50 restricts outward movement of the panels 74,76 beyond the extended position. For example, the sidewalls 34 restrict the panels 74,76 from pivoting outwardly substantially beyond the extended position. In this manner, the sidewalls 34 provide reinforcement for the panels 74,76.

Turning to FIGS. 12 and 13, the panels 74,76 are configured to interconnect with one another when all are in the extended position and reinforce each other from shifting substantially beyond the extended position, i.e., in an outward direction from the container 20. More specifically, the grooves 90 are configured to receive the corresponding rib element 106 from adjacent end panels 76. Thus, each flange element 88 and rib element 106 cooperatively form an interlocking joint. Furthermore, the side elements cooperate to restrict outward pivotal movement of the end panels 74 substantially beyond the extended position because the flange elements 88 limit such movement when interconnected with the respective rib elements 106. Similarly, the end panels 76 cooperate to restrict outward pivotal movement of the side panels 74 substantially beyond the extended position because the rib elements 106 limit that movement.

The locking fasteners 110 further interconnect and lock the panels 74,76 to one another so that the end panels 76 do not inadvertently pivot out of the extended position. The locking fasteners 110 are configured to engage a corresponding aperture 122 in the side panels 74 when the rib element 106 is fully received in the groove 90. The bolt 114 is operable to slide outwardly to extend an end thereof into the aperture 122. Although the illustrated locking fastener 110 is preferred for interconnecting the panels 74,76, it is within the ambit of the present invention to use other types of locks or fasteners to prevent inadvertent shifting of the panels 74,76.

Turning to FIGS. 1-9, the interconnecting joints between each pair of panels 74,76 are also advantageous in that they prevent tampering with the load L and also because they are tamper-evident, i.e., they indicate when the container 20 has been breached due to tampering. In particular, each flange element 88 becomes interconnected with the corresponding rib element 106 so that the flange element 88 covers the rib element 106 from the sidewall 34 to the lid assembly 24 and thereby effectively hides the rib element 106 from a point of view external to the container 20 (see FIG. 9). Furthermore, the joint formed by the elements 88,106 includes ends that are substantially hidden by, respectively, the sidewalls 34 and the lid assembly 24. In this manner, the joint is difficult to breach because a person attempting to open the joint must be able to see both joint elements to determine how the joint can be separated. As will be discussed, other tamper-evident devices can be used to secure the container 20.

Again, the panels 74,76 are shiftable between retracted and extended positions. When retracted, the panels 74,76 are preferably entirely spaced within the chamber 36 so that the lid assembly 24 can be placed on tie box 22 to enclose the chamber 36 and the container 20 is in its fully collapsed configuration (see FIGS. 2 and 5). The retracted panels 74,76 are preferably interleaved with one another so as to be efficiently stored in the chamber 36. In the retracted position, the side panels 74 are preferably positioned on top of the end panels 76.

Figure 6:
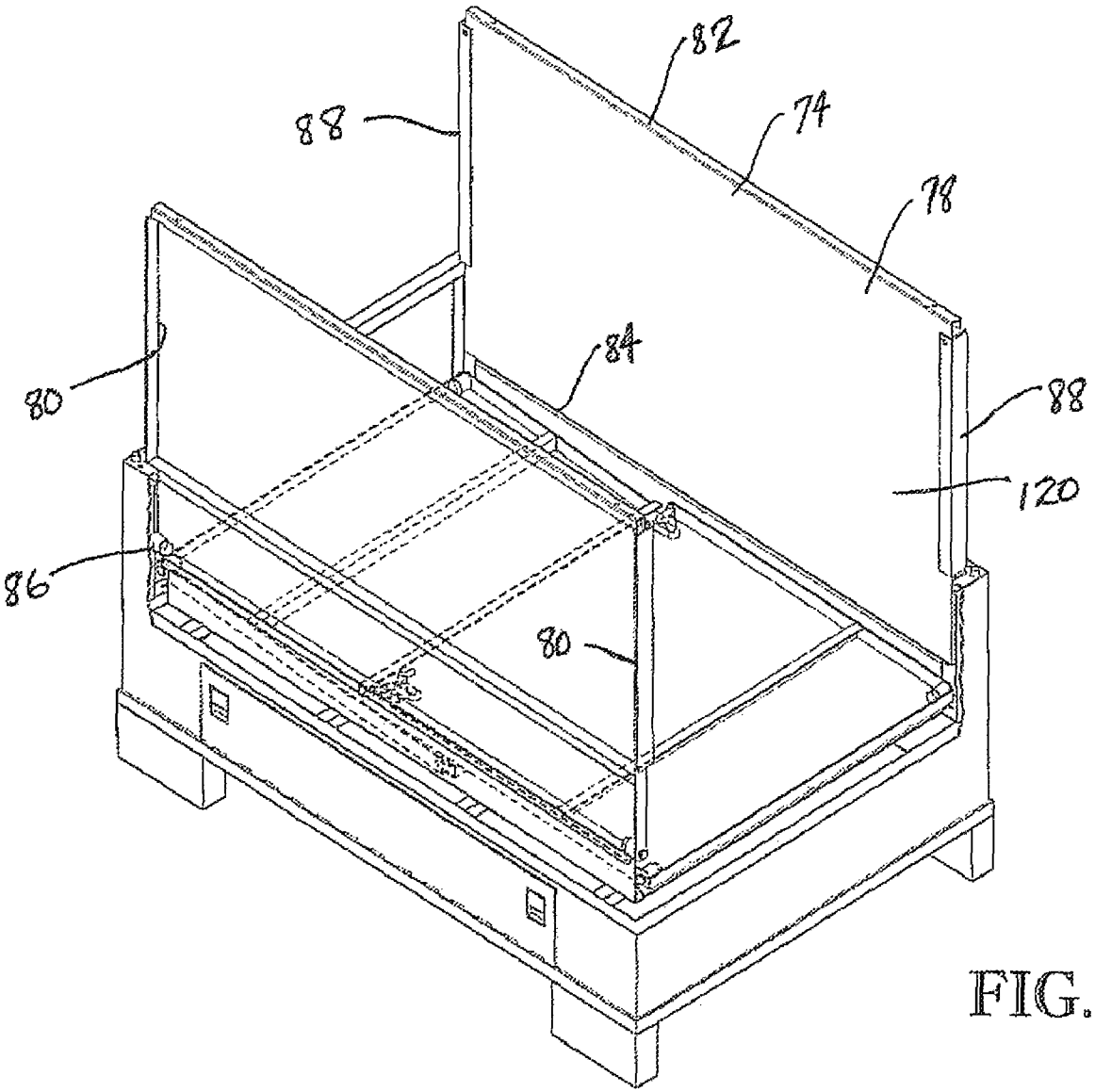
FIG. 6 is a fragmentary perspective view of the collapsible container shown in FIGS. 1-5, showing the foldable side panels pivoted into an extended position.

The panels 74,76 are shifted into the extended position by first pivoting the side panels 74 into an upright orientation (see FIG. 6). The end panels 76 are then operable to be pivoted into an upright orientation, with the rib elements 106 slidably engaging the flange elements 88. With the panels 74,76 extended, a gap is presented between the panels 74,76 and the corresponding sidewalls 34. However, the stiffeners 92,108 project to the sidewalls 34 adjacent the upper rim 50 to cover the intervening gap (see FIG. 7). The extended panels 74,76 present upper edges that cooperatively form an open container top 123.

The panels 74,76 are retracted by first releasing the locking fasteners 10 by sliding the bolts 114 out of engagement with the respective aperture 122. The end panels 76 can then be pivoted inwardly into a position within the chamber 36. With the end panels 76 resting on top of the floor 32, the side panels 74 can be pivoted to rest on top of the end panels 76 in the retracted position. In the retracted position, the panels 74,76 are entirely received in the chamber 36.

Figure 2:
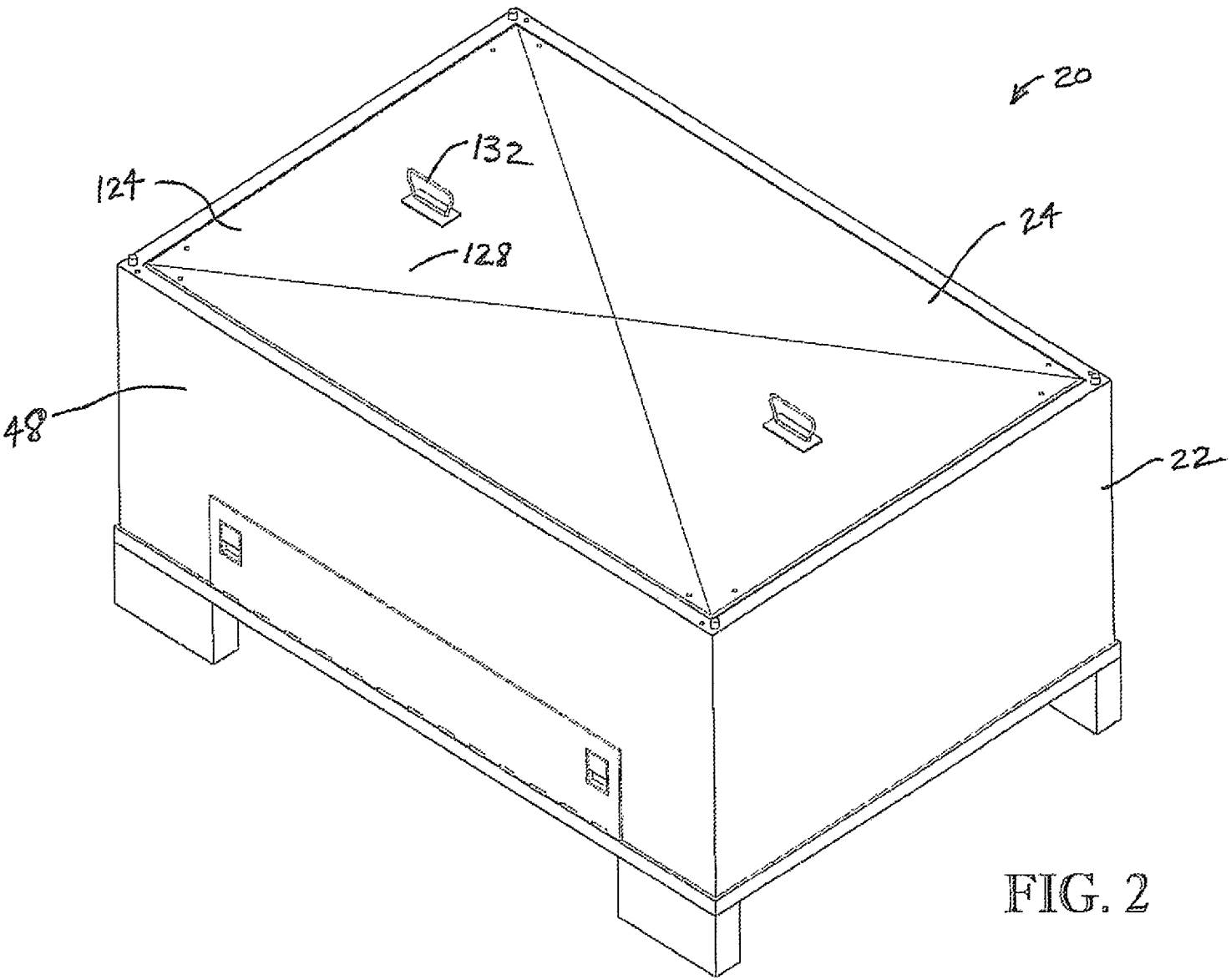
FIG. 2 is a perspective view of the collapsible container shown in FIG. 1, showing the stanchions and load removed from the box, with the container being in a collapsed configuration.

Turning to FIGS. 2 and 14, the lid assembly 24 includes a lid 124 and tamper-evident seals 126. The lid 124 includes a cover 128, a rim 130 attached to the cover 128, and handles 132. The rim 130 extends around a perimeter of the cover 128. The cover 128 is formed from a flat sheet to present a "Tenors-X" configuration with breaks that cross one another in the usual manner. However, the lid 124 could include corrugated sections or structural beam elements for suitably reinforcing the cover 128. When the container 20 is collapsed, the lid 124 can be received on a ledge presented by the support tabs 54. When the container 20 is expanded, the lid 124 is received onto the panels 74,76 with the rim 130 surrounding the upper edges of the panels 74,76 and the lid 124 covering the open container top 123. The lid 124 is configured to be removed for selectively accessing the chamber 36 and, consequently, for loading and unloading of the load L. When the container 20 is storing the load L, however, the seals 126 are configured to restrict tampering by removing the lid 124. In particular, the lid 124 and end panels 76 both include four sets of seal holes 133 (with only one set being shown in FIG. 14). The seal holes 133 preferably receive up to four tamper-evident seals 126 so that the lid 124 can be entirely removed from the panels 74,76 only by destroying the seals 126. This tamper-evident mechanism along with the unique tamper-evident construction of the panel joints cooperatively identify when any tampering of the container 20 has occurred and deters tampering.

Figure 3:
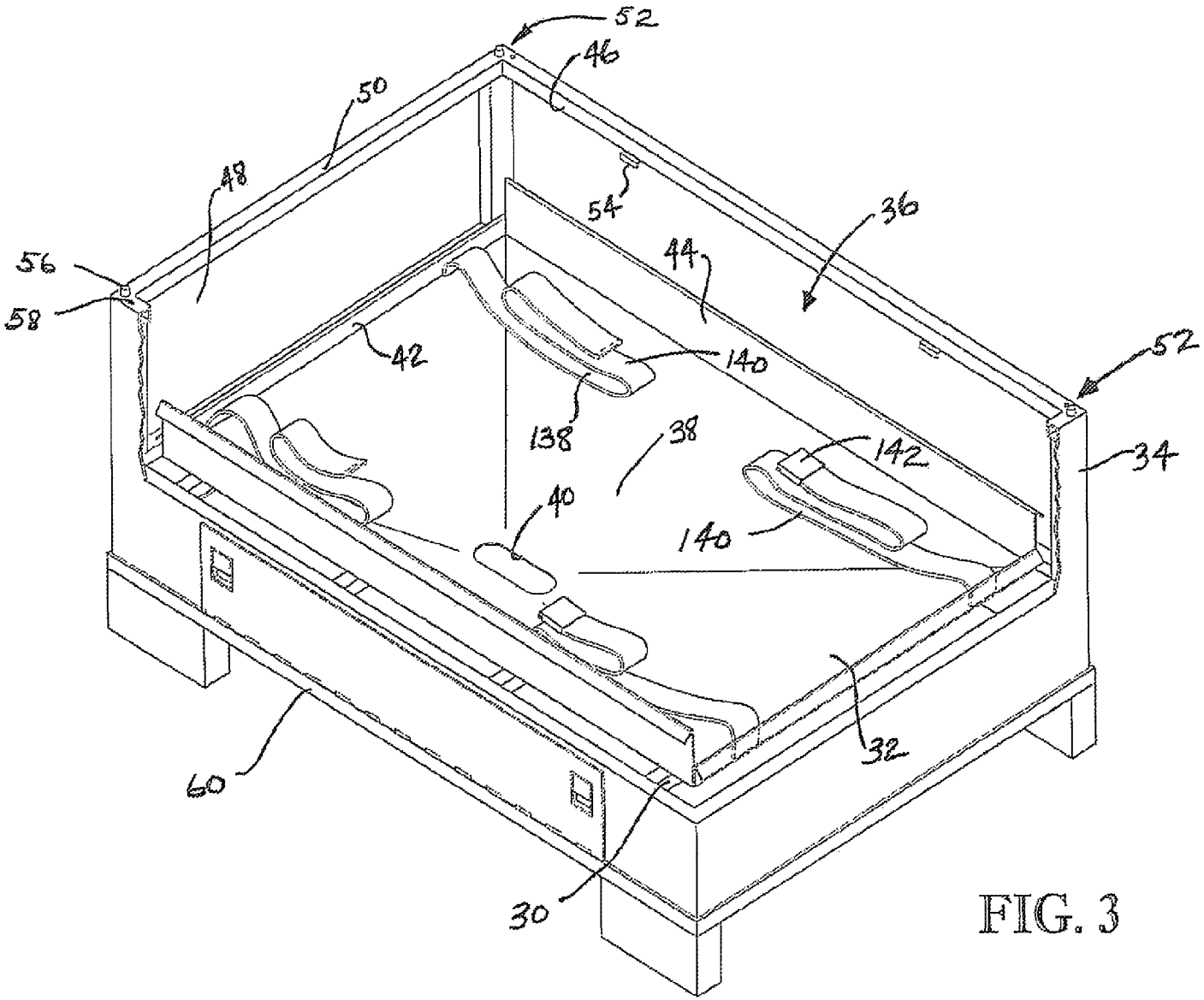
FIG. 3 is a fragmentary perspective view of the collapsible container shown in FIGS. 1 and 2, showing features of the box including a platform, sidewalls, frame, and floor, and showing strap assemblies of the container, with a portion of the box sidewalls removed.
Figure 4:
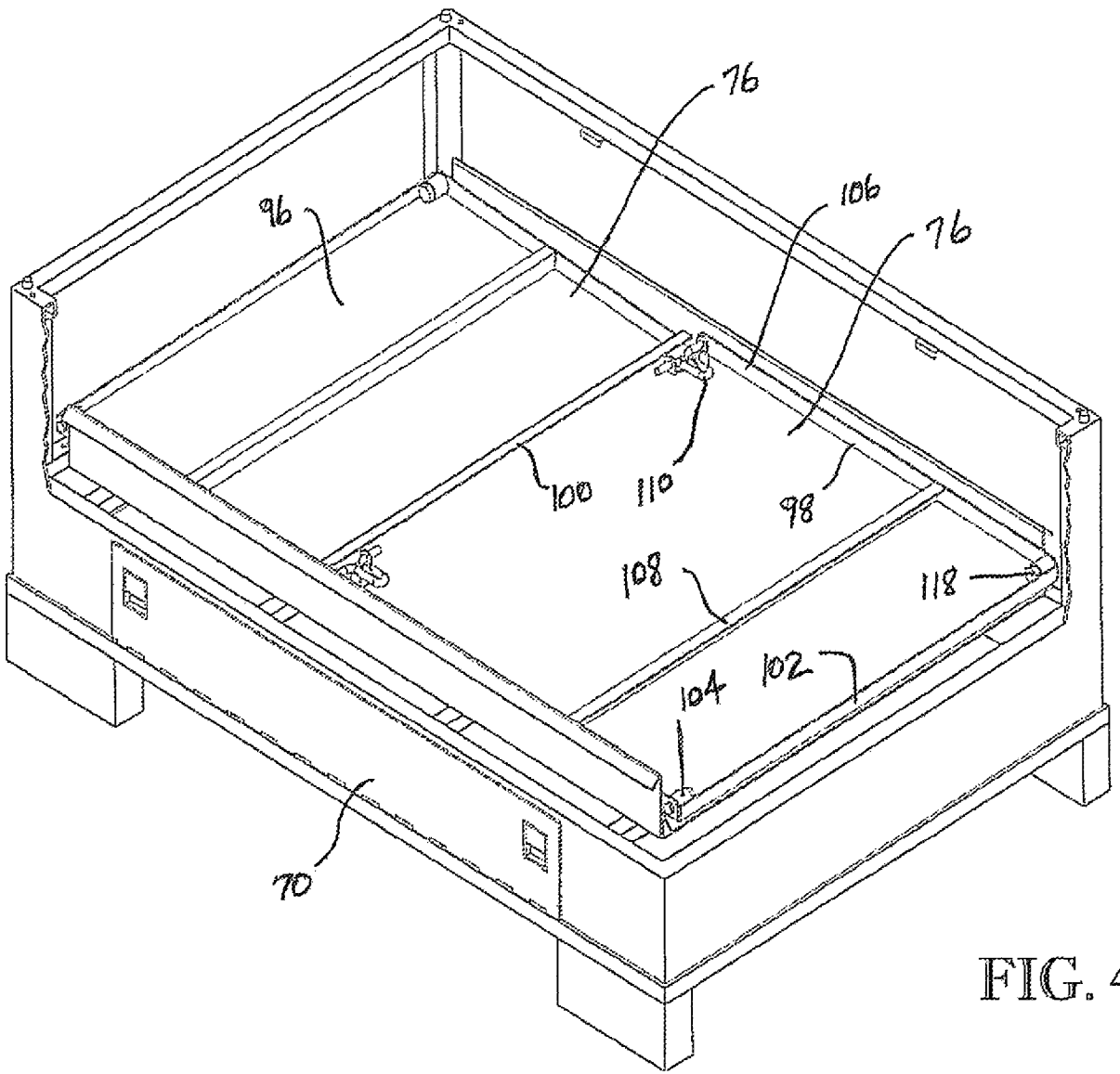
FIG. 4 is a fragmentary perspective view of the collapsible container shown in FIGS. 1-3, showing foldable end panels of the box positioned in a retracted position and spaced within a chamber of the box.
Figure 5:
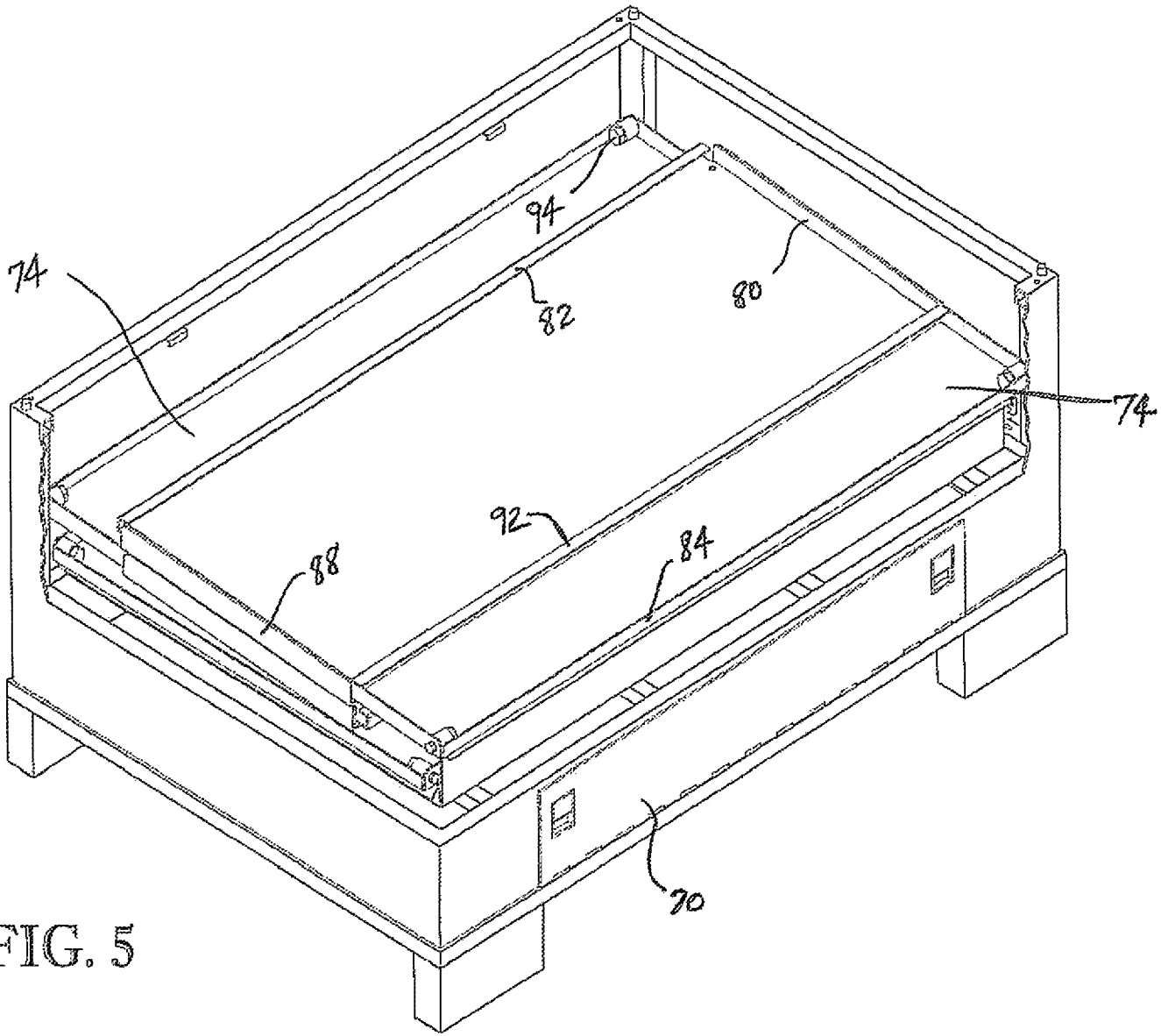
FIG. 5 is a rear fragmentary perspective view of the collapsible container shown in FIGS. 1-4, showing foldable side panels of the box positioned in the retracted position and spaced within the chamber.

Turning to FIGS. 1, 3, and 7, the retaining assembly 26 broadly includes strap assemblies 134 and a retainer plate 136. The strap assemblies 134 include a strap 138 with ends 140 and a clasp 142 for securing ends 140. The strap 138 is fed through slots 144 presented in the floor 32 (see FIG. 12), with the ends 140 extending upwardly into the chamber 36. The retainer plate 136 includes a substantially flat wall 146 and handles 148 attached thereto for lifting the retainer plate 136. The wall 146 presents a rectangular aperture 150 for receiving liner B. The retainer plate 136 is sized and configured to fit within the chamber 36. More particularly, the retainer plate 136 presents a peripheral edge 152 that extends closely along the panels 74,76 when the retainer plate 136 is in a laterally extending orientation.

Turning to FIG. 8, the chamber 36 is configured to receive the liner B. The illustrated liner B includes a liner wall W, a connector fitting C attached to the wall W, a valve V, and a hose H. With the liner B received in chamber 36, the connector fitting C extends through the opening 40 and into the compartment 72. The hose H is attached to the valve V and extends through the compartment 72 and through the access opening 68. In this manner, the liner B can conveniently discharge fluid F by gravity through the floor 32 and out of the compartment 72. While the illustrated connector fitting C, wall W, and valve V are constructed as part of the liner B, it is also within the ambit of the present invention where this structure is manufactured as part of the container 20, e.g., by attaching this structure to the floor 32 in fluid communication with the opening 40. The liner wall W also includes an end E that presents an uppermost opening for adding or removing fluid F (see FIG. 7).

When the load L is received in the chamber 36, the retainer plate 136 is configured to substantially cover the load L. The illustrated container is generally oriented so that the chamber 36 is filled in an upward direction from the floor 32. As the level of material rises (or lowers) within the chamber 36, the retainer plate 136 is operable to be repositioned to cover the load L.

Turning back to FIG. 7, the strap assemblies 134 are operable to secure the retainer plate 136 into firm engagement with the load L. Specifically, the illustrated strap ends 140 are configured to extend between the load L and the panels 74,76 and above the retainer plate 136, with the ends 140 operable to be secured to one another by the clasp 142 above the retainer plate 136. In this manner, the strap assemblies 134 can be adjustably tightened to force the retainer plate 136 in a downward direction onto the load L. This securement of the load L is preferable for various reasons. In particular, the compressive force supplied by the retainer plate 136 restricts the fluid F from shifting within the chamber 36. By limiting this shifting movement, the container 20 is less prone to instability or tipping during movement thereof.

Turning to FIGS. 9-13, the container 20 further includes removable stanchions 28*a,b*. Stanchion 28*a* is preferably unitary and includes an elongated body 154 and upper and lower end sections 156,158 welded at each end of the elongated body 154. The elongated body 154 preferably includes a right angle shape so that the stanchion 28*a,b* can be spaced closely adjacent to the panels 74,76. The lower end section 158 includes a gusset 160 that is welded to the elongated body 154 and presents a hole 162. The lower end section 158 further includes a pin 164 welded to the gusset 160. The upper end section 156 includes a gusset 166 that is welded to the elongated body 154, an upstanding boss 168 welded to an upper side of the gusset 166, and a pin 170 welded to a lower side of the gusset 166. Stanchions 28*a* and stanchions 28*b* are preferably identical to one another except for being substantially mirror images of one another.

Figure 9:
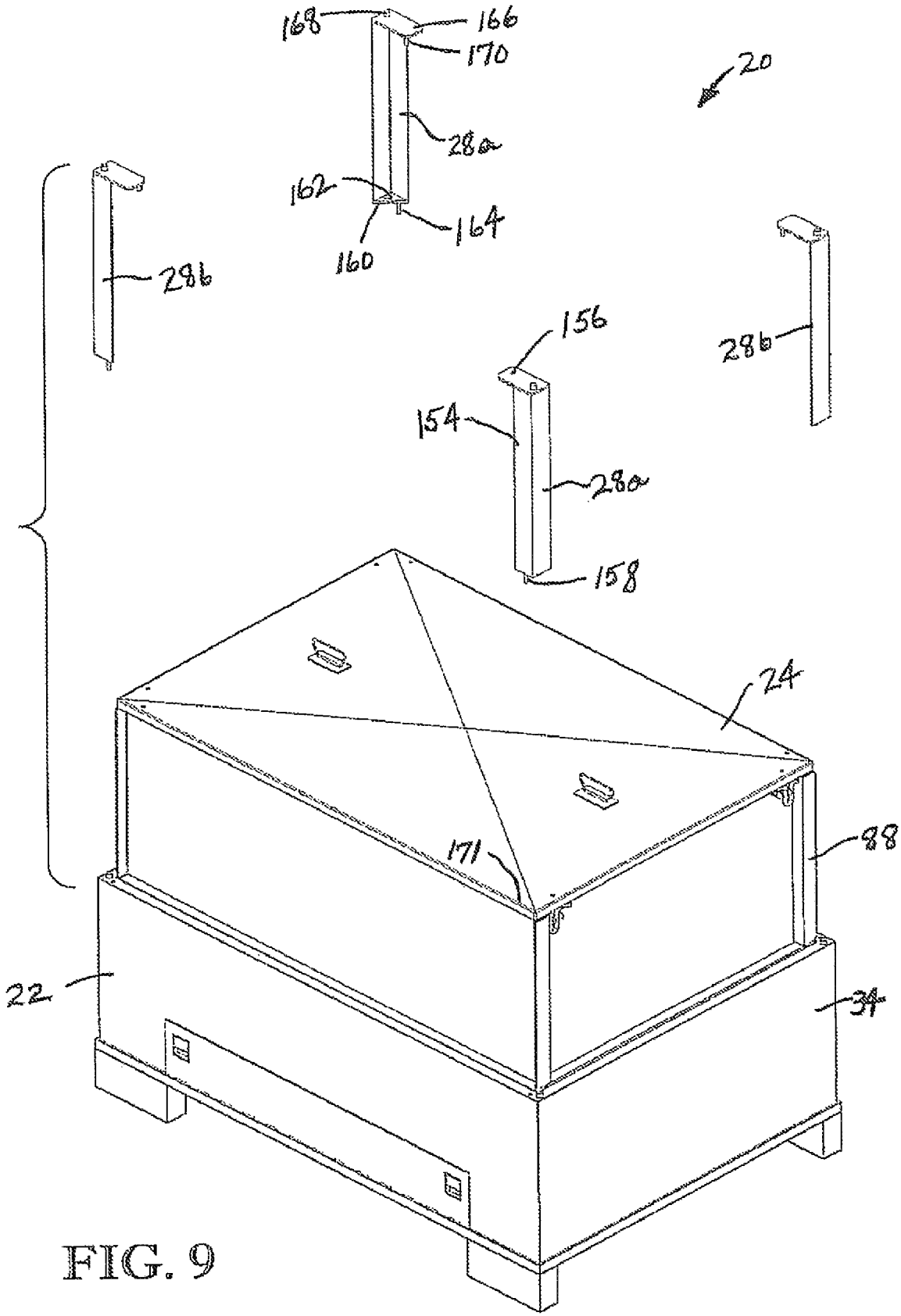
FIG. 9 is a partly exploded view of the collapsible container in an expanded configuration as shown in FIG. 1, showing the stanchions exploded from a remainder of the container.

Turning to FIGS. 9, 12, and 13, the stanchions 28*a,b* are applied to container 20 by inserting pin 164 into the corresponding aperture 58 and inserting boss 56 into the hole 162. Additionally, pin 170 can be inserted into stanchion holes 171 formed in the lid 24 and the upper edges 82 of side panels 74 if the container 20 is in the expanded configuration. The stanchions 28*a,b* are removably attached with a predetermined orientation relative to the box 22. Furthermore, the stanchions 28*a,b* are operable to lock the lid 24 relative to the side panels 74.

Figure 10:
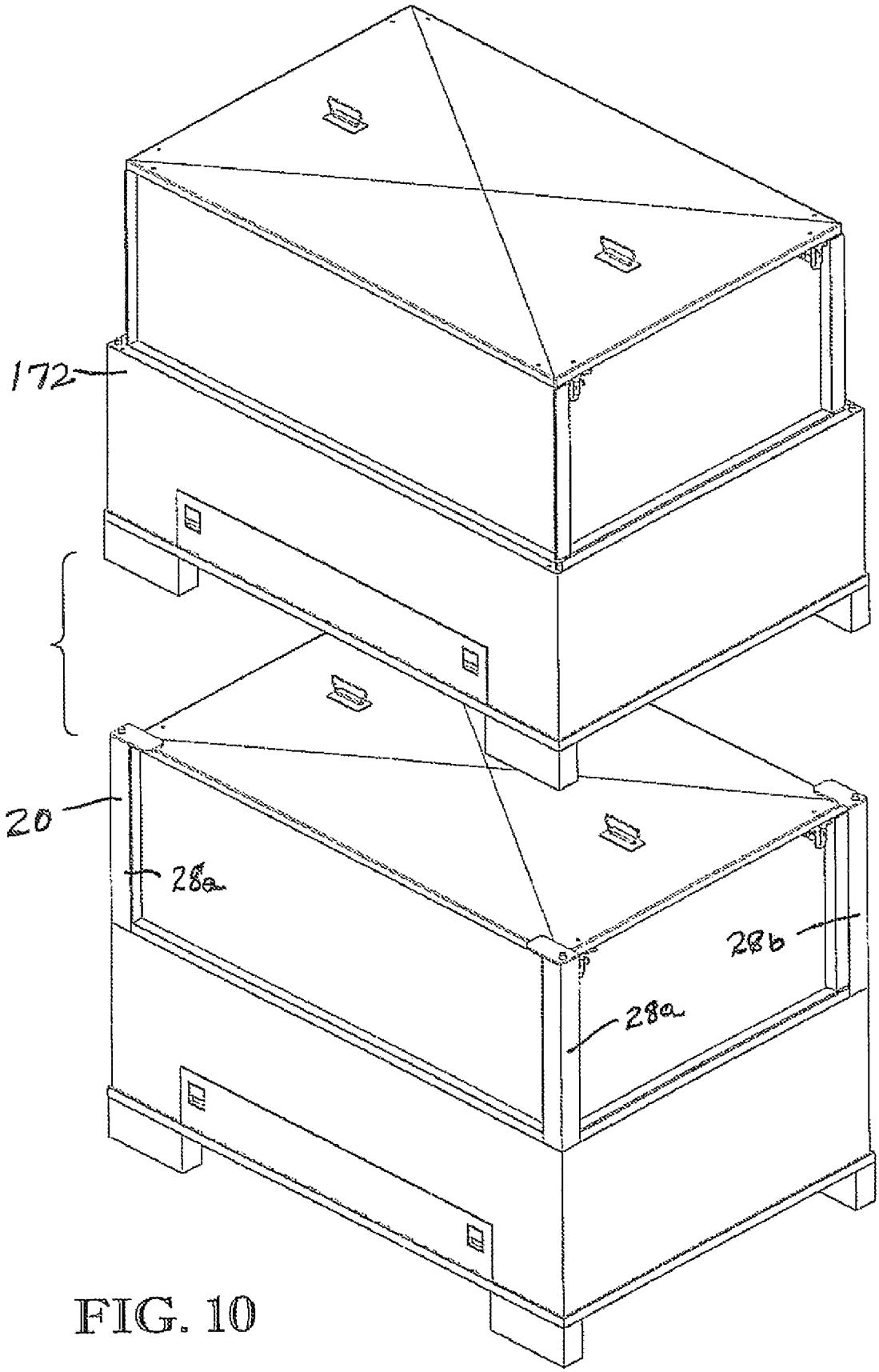
FIG. 10 is an exploded view of a pair of collapsible containers in an expanded configuration as shown in FIGS. 1 and 9, showing a first container positioned above a second container, with stanchions being attached to the second container and operable to receive the first container thereon.

Turning to FIGS. 10, 11, and 13, the stanchions 28*a,b* are also configured to support another container 172 that is identical to container 20. The feet 64 present a lowermost hole 174 for receiving the corresponding boss 168. Thus, container 172 can be stacked on top of container 20 by arranging the feet 64 onto the corresponding stanchions 28*a,b* until the bosses 168 are received within respective holes 174.

For the container 20 in its collapsed condition, i.e., when the panels 74,76 are retracted, to support container 172, the stanchions 28*a,b* are removed from the box 22. The feet 64 of the container 172 are then arranged on the support sections 52 until the bosses 56 are received in the corresponding holes 174. While the stanchions 28*a,b* are generally used when the container 20 is expanded, the stanchions 28*a,b* can also be used to support container 172 when the container 20 is collapsed.

The stanchions 28*a,b* preferably support the container 172 when the container 20 is extended so that the panels 74,76 support, at most, only part of the container 172. As shown in FIG. 13, the gusset 166 is spaced apart from the lid 24 and panels 74,76 so that either no weight or minimal weight of container 172 is transmitted through the panels 74,76. Thus, the panels 74,76 are exposed to relatively small loads and can be manufactured more economically than if the panels 74,76 were required to support a container 172 storing a load therein.

In operation, the container 20 can be stored in either a collapsed or expanded configuration. The container 20 is readily shiftable from the collapsed configuration to the expanded configuration by unfolding and positioning the panels 74,76 into an expanded position where the panels 74,76 are securely interconnected. The panels 74,76 serve to expand the chamber 36 for receiving the load L. The load L is secured by installing the retaining assembly 26. Specifically, the retainer plate 136 is positioned above the load L and is forced into secure engagement with the load L by strap assemblies 134. The retaining assembly 26 restricts unintended shifting of the load L. Access to fluid F within the bag B is obtained either above the load L through a rectangular aperture 150 of the retainer plate 136 or through the auxiliary compartment 72 below the load L. The container 20 is stackable with like containers 20 either when the containers 20 are collapsed or when the containers 20 are expanded and are storing material. Stanchions 28 are selectively attached to the sidewalls 34 to provide reinforcement in supporting a stacked container 20, particularly when the stacked container is carrying material.

The preferred forms of the invention described above are to be used as illustration only, and should not be utilized in a limiting sense in interpreting the scope of the present invention. Obvious modifications to the exemplary embodiments, as hereinabove set forth, could be readily made by those skilled in the art without departing from the spirit of the present invention.

The inventor hereby state his intent to rely on the Doctrine of Equivalents to determine and assess the reasonably fair scope of the present invention as pertains to any apparatus not materially departing from but outside the literal scope of the invention as set forth in the following claims.

What is claimed is:

1. A collapsible container configured for holding a bulk material load therein and operable to restrict tampering with the load, the collapsible container comprising:

a box including a floor and a sidewall surrounding the floor, with the floor and sidewall being interconnected to form a load-receiving chamber that is operable to receive the bulk material load, said sidewall presenting an upper edge spaced upwardly from the floor, said box including a plurality of panels shiftably attached to a remainder of the box at a location spaced vertically between the floor and the upper edge and projecting uprightly above the sidewall in an extended position to expand the chamber, with the panels presenting uppermost edge sections that form an open container top and with the plurality of panels operable to be folded from the extended position to a retracted position, said plurality of panels being entirely within the chamber in the retracted position; and a lid including a rim that receives the uppermost edge sections, with the lid overlying the open container top to enclose the chamber, said sidewall including a ledge that is spaced within the chamber and extends along the upper edge with the lid operable to be received on the ledge to enclose the chamber when the plurality of panels are in the retracted position, said plurality of panels including a pair of adjacent panels with interconnected joint elements, said joint elements extending substantially from the upper edge to the rim and defining a seam therebetween, one of said joint elements presenting an external surface that covers the other joint element from the upper edge to the rim to restrict access through the seam and into the chamber.

2. The collapsible container as claimed in claim 1, said plurality of panels comprising first and second pairs of panels, said first pair of panels being pivotally attached to the remainder of the box at a first vertical location, said second pair of panels being pivotally attached to the remainder of the box at a second vertical location spaced vertically from the first vertical location.

3. The collapsible container as claimed in claim 1, said plurality of panels being interleaved with one another in the refracted position.

4. The collapsible container as claimed in claim 1, each of said plurality of panels being pivotally attached to the sidewall, with the sidewall restricting outward pivotal movement of the panels beyond the extended position.

5. The collapsible container as claimed in claim 1, said plurality of panels comprising first and second pairs of panels, said first pair of panels having to be unfolded before the second pair of panels are unfolded.

6. The collapsible container as claimed in claim 5, each of said first pair of panels including a flange at each end thereof, each of said second pair of panels having ribs at each end thereof, with the first pair of panels cooperatively restricting outward pivotal movement of the second pair of panels beyond the extended position.

7. The collapsible container as claimed in claim 1 further comprising, an adjustable strap attached to the box and spaced within the chamber, said adjustable strap being configured to secure the bulk material load in the load-receiving chamber.

8. The collapsible container as claimed in claim 7, said adjustable strap including a pair of strap elements and a clasp, each of said strap elements having an end attached to the box, with the clasp securing the strap elements to one another.

9. The collapsible container as claimed in claim 1, said joint elements forming a joint having opposite ends, with one end being received adjacent the box and the other end being adjacent the lid so that the ends are hidden to restrict tampering.

10. The collapsible container as claimed in claim 1, one of the joint elements comprising a flange that presents a groove and the other of the joint elements comprising a rib received in the groove, with the flange presenting the external surface.

11. The collapsible container as claimed in claim 1 further comprising, a stanchion rigidly attached to the box and projecting above the lid for supporting another container, said stanchion operable to support at least part of the another container, with the panels being configured to support any remaining part of the another container.

12. The collapsible container as claimed in claim 1, said box including a shelf that is spaced below the floor and is interconnected with the sidewall to form an auxiliary compartment, said floor presenting a discharge opening, with the chamber and compartment fluidly communicating with one another through the opening, said sidewall presenting an access opening that communicates with the compartment.

13. The collapsible container as claimed in claim 12, said floor being sloped downwardly towards said discharge opening.

14. The collapsible container as claimed in claim 1, said chamber operable to be filled in an upright fill direction from the floor; and a substantially rigid wall shiftably attached to the box, said rigid wall extending transversely to the fill direction, with the rigid wall having a perimeter that extends along the sidewall, said rigid wall being operable to translate in the fill direction between a plurality of load-engaging positions within the chamber.

15. A stackable container operable to support a substantially similar container stacked thereon, the stackable container comprising:

a box including a floor and a sidewall surrounding the floor, with the floor and sidewall being interconnected to form a load-receiving chamber, said sidewall presenting an upper edge spaced upwardly from the floor, said box including a plurality of panels pivotally attached to a remainder of the box at a location spaced vertically between the floor and the upper edge, and projecting uprightly above the sidewall in an extended position to expand the chamber, with the panels presenting uppermost edge sections that form an open container top in the extended position, and configured to shift between the extended position and a retracted position;

a lid overlying the open container top to enclose the chamber; and a stanchion rigidly attached to the box and projecting above the lid to receive the similar container, said stanchion operable to support at least part of the similar container, with the panels being configured to support any remaining part of the similar container.

16. The stackable container as claimed in claim 15, said plurality of panels being shiftable independently of the stanchion.

17. The stackable container as claimed in claim 15, said box including a lowermost foot that supports the box, said upper edge including a support section that is complementally shaped to receive and support the lowermost foot of the similar container.

18. The stackable container as claimed in claim 17, said stanchion being removable from the box so that the support section is operable to receive the lowermost foot of the similar container when the plurality of panels are retracted.

19. The stackable container as claimed in claim 18, said lid operable to fit within the chamber when the plurality of panels are retracted so that the support section is spaced at or above the lid.

20. The stackable container as claimed in claim 17, said stanchion including upper and lower ends, with the lower end being removably attached to the support section, said stanchion including an end section along the upper end, with the end section being substantially identical to the support section and complementally shaped to receive the lowermost foot of the similar container.

21. The stackable container as claimed in claim 20, said lid fitting onto the plurality of panels so that the end section is spaced at or above the lid.

22. The stackable container as claimed in claim 15, said container comprising a plurality of stanchions.

23. The stackable container as claimed in claim 15, said plurality of panels comprising first and second pairs of panels, said first pair of panels being pivotally attached to the remainder of the box at a first vertical location, said second pair of panels being pivotally attached to the remainder of the box at a second vertical location spaced vertically from the first vertical location.

24. The stackable container as claimed in claim 15, said plurality of panels being interleaved with one another in the retracted position.

25. The stackable container as claimed in claim 15, said plurality of panels being entirely within the chamber in the refracted position.

26. The stackable container as claimed in claim 25, said sidewall including a ledge that is spaced within the chamber and extends along the upper edge, with the lid operable to be received on the ledge to enclose the chamber when the plurality of panels are in the refracted position.

27. The stackable container as claimed in claim 15, each of said plurality of panels being pivotally attached to the sidewall, with the sidewall restricting outward pivotal movement of the panels beyond the extended position.

28. The stackable container as claimed in claim 15, said plurality of panels comprising first and second pairs of panels, said first pair of panels having to be unfolded before the second pair of panels are unfolded.

29. The stackable container as claimed in claim 28, said first and second pairs of panels each including opposite side edges, each of said first pair of panels including a flange along each side edge, each of said second pair of panels having ribs along each side edge, with each rib being received by a corresponding one of the flanges, said first pair of panels cooperatively restricting outward pivotal movement of the second pair of panels beyond the extended position.

30. The stackable container as claimed in claim 15 further comprising, an adjustable strap attached to the box and spaced within the chamber, said adjustable strap being configured to secure the bulk material load in the load-receiving chamber.

31. The stackable container as claimed in claim 30, said adjustable strap including a pair of strap elements and a clasp, each of said strap elements having an end attached to the box, with the clasp securing the strap elements to one another.

32. The stackable container as claimed in claim 15, said box including a shelf that is spaced below the floor and is interconnected with the sidewall to form an auxiliary compartment, said floor presenting a discharge opening, with the chamber and compartment fluidly communicating with one another through the opening, said sidewall presenting an access opening that communicates with the compartment.

33. The stackable container as claimed in claim 32, said floor being sloped downwardly towards said discharge opening.

34. The stackable container as claimed in claim 15, said chamber operable to be filled in an upright fill direction from the floor; and a substantially rigid wall shiftably attached to the box, said rigid wall extending transversely to the fill direction, with the rigid wall having a perimeter that extends along the sidewall, said rigid wall being operable to translate in the fill direction between a plurality of load-engaging positions within the chamber.

35. A bulk storage container configured for holding a bulk material load therein and for discharging the bulk material load through a conduit, the bulk storage container comprising:

a box including a floor and a sidewall surrounding the floor, with the floor and sidewall being interconnected to form a load-receiving chamber that is operable to receive the bulk material load, said sidewall presenting an upper edge spaced upwardly from the floor, said box including a shelf that is spaced below the floor and is interconnected with the sidewall to form an auxiliary compartment, said floor presenting a discharge opening, with the chamber and compartment fluidly communicating with one another through the discharge opening, said sidewall presenting an access opening that communicates with the compartment so that the conduit is operable to extend between the openings to discharge the bulk material load through the auxiliary compartment;

said chamber operable to be filled in an upright fill direction from the floor; and a substantially rigid wall shiftably attached to the box, said rigid wall extending transversely to the fill direction, with the rigid wall having a perimeter that extends along the sidewall, said rigid wall being operable to translate in the fill direction between a plurality of load-engaging positions within the chamber.

36. The bulk storage container as claimed in claim 35, said box including a door pivotally attached to the sidewall and operable to cover the access opening when closed.

37. The bulk storage container as claimed in claim 35, said discharge opening being spaced apart from the sidewall.

38. The bulk storage container as claimed in claim 35, said floor being sloped downwardly towards said discharge opening.

39. The bulk storage container as claimed in claim 35, said box including a plurality of panels attached to a remainder of the box and projecting uprightly above the sidewall in an extended position to expand the chamber, with the panels presenting uppermost edge sections that form an open container top.

40. The bulk storage container as claimed in claim 39, said plurality of panels being shiftably attached to the remainder of the box and configured to shift between the extended position and a retracted position.

41. The bulk storage container as claimed in claim 40, said plurality of panels being pivotally attached to the remainder of the box at a location spaced vertically between the floor and the upper edge, with the plurality of panels operable to be folded from the extended position to the refracted position.

42. The bulk storage container as claimed in claim 41, said plurality of panels comprising first and second pairs of panels, said first pair of panels being pivotally attached to the remainder of the box at a first vertical location, said second pair of panels being pivotally attached to the remainder of the box at a second vertical location spaced vertically from the first vertical location.

43. The bulk storage container as claimed in claim 41, said plurality of panels being interleaved with one another in the retracted position.

44. The bulk storage container as claimed in claim 41, said plurality of panels being entirely within the chamber in the refracted position.

45. The bulk storage container as claimed in claim 44 further comprising, a lid overlying the open container top to enclose the chamber, said sidewall including a ledge that is spaced within the chamber and extends along the upper edge, with the lid operable to be received on the ledge to enclose the chamber when the plurality of panels are in the retracted position.

46. The bulk storage container as claimed in claim 40, each of said plurality of panels being pivotally attached to the sidewall, with the sidewall restricting outward pivotal movement of the panels beyond the extended position.

47. The bulk storage container as claimed in claim 40, said plurality of panels comprising first and second pairs of panels, said first pair of panels having to be unfolded before the second pair of panels are unfolded.

48. The bulk storage container as claimed in claim 47, said first and second pairs of panels each including opposite side edges, each of said first pair of panels including a flange along each side edge, each of said second pair of panels having ribs along each side edge, with each rib being received by a corresponding one of the flanges, said first pair of panels cooperatively restricting outward pivotal movement of the second pair of panels beyond the extended position.

49. The bulk storage container as claimed in claim 35 further comprising, an adjustable strap attached to the box and spaced within the chamber, said adjustable strap being configured to secure the bulk material load in the load-receiving chamber.

50. The bulk storage container as claimed in claim 49, said adjustable strap including a pair of strap elements and a clasp, each of said strap elements having an end attached to the box, with the clasp securing the strap elements to one another.

51. The bulk storage container as claimed in claim 35, said box further including feet that are integrally connected with the sidewall and extend below the shelf to support the box and present a lifting space.

52. A bulk storage container configured for holding a bulk material load therein, the bulk storage container comprising:

a box including a floor and a sidewall surrounding the floor, with the floor and sidewall being interconnected to form a load-receiving chamber that is operable to receive the bulk material load, said box including a plurality of panels attached to a remainder of the box and projecting uprightly above the sidewall in an extended position to expand the chamber, with the panels presenting uppermost edge sections that form an open container top, said chamber operable to be filled in an upright fill direction from the floor; and a substantially rigid wall shiftably attached to the box, said rigid wall extending transversely to the fill direction, with the rigid wall having a perimeter that extends along the sidewall, said rigid wall being operable to translate in the fill direction between a plurality of load-engaging positions within the chamber.

53. The bulk storage container as claimed in claim 52 further comprising, an adjustable strap secured to the box and extending across the chamber to hold the rigid wall in engagement with the bulk material load.

54. The bulk storage container as claimed in claim 53, said strap being secured to the box below the rigid wall and extending above at least part of the rigid wall.

55. The bulk storage container as claimed in claim 54 said strap including at least two strap elements that are attached to the box and are joined to one another to cooperatively hold the rigid wall.

56. The bulk storage container as claimed in claim 52, said rigid wall substantially spanning the chamber to cover the load within the chamber.

57. The bulk storage container as claimed in claim 52, said box presenting an open top, said rigid wall being configured to lie between the bulk material load and the open top.

58. The bulk storage container as claimed in claim 52, said plurality of panels being shiftably attached to the remainder of the box and configured to shift between the extended position and a retracted position.

59. The bulk storage container as claimed in claim 58, said plurality of panels being pivotally attached to the remainder of the box at a location spaced vertically between the floor and the upper edge, with the plurality of panels operable to be folded from the extended position to the retracted position.

60. The bulk storage container as claimed in claim 59, said plurality of panels comprising first and second pairs of panels, said first pair of panels being pivotally attached to the remainder of the box at a first vertical location, said second pair of panels being pivotally attached to the remainder of the box at a second vertical location spaced vertically from the first vertical location.

61. The bulk storage container as claimed in claim 59, said plurality of panels being interleaved with one another in the retracted position.

62. The bulk storage container as claimed in claim 59, said plurality of panels being entirely within the chamber in the retracted position.

63. The bulk storage container as claimed in claim 62 further comprising, a lid overlying the open container top to enclose the chamber, said sidewall including a ledge that is spaced within the chamber and extends along the upper edge, with the lid operable to be received on the ledge to enclose the chamber when the plurality of panels are in the retracted position.

64. The bulk storage container as claimed in claim 58, each of said plurality of panels being pivotally attached to the sidewall, with the sidewall restricting outward pivotal movement of the panels beyond the extended position.

65. The bulk storage container as claimed in claim 58, said plurality of panels comprising first and second pairs of panels, said first pair of panels having to be unfolded before the second pair of panels are unfolded.

66. The bulk storage container as claimed in claim 65, said first and second pairs of panels each including opposite side edges, each of said first pair of panels including a flange along each side edge, each of said second pair of panels having ribs along each side edge, with each rib being received by a corresponding one of the flanges, said first pair of panels cooperatively restricting outward pivotal movement of the second pair of panels beyond the extended position.

* * * * *